United States Patent [19]

Hoernschemeyer et al.

[11] 4,282,090

[45] Aug. 4, 1981

[54] ROTARY SIFTING DEVICE

[75] Inventors: August B. Hoernschemeyer; Alan L. Zinser, both of St. Louis County; John F. Myers, Jefferson County, all of Mo.

[73] Assignee: St. Louis Conveyor Company Inc., St. Louis, Mo.

[21] Appl. No.: 155,211

[22] Filed: Jun. 20, 1980

[51] Int. Cl.[3] ..... B07B 1/24; B07B 1/55

[52] U.S. Cl. ..... 209/291; 209/297; 209/380

[58] Field of Search ..... 209/289–291, 209/294–299, 379, 380

[56] References Cited

U.S. PATENT DOCUMENTS

| | | | |
|---|---|---|---|
| 1,223,607 | 4/1917 | Pantaze | 209/291 |
| 1,236,256 | 8/1917 | Brace | 209/291 |
| 3,737,035 | 6/1973 | Allan | 209/299 X |
| 4,043,901 | 8/1977 | Gauld | 209/294 X |

*Primary Examiner*—William A. Cuchlinski, Jr.
*Attorney, Agent, or Firm*—Lionel L. Lucchesi

[57] ABSTRACT

A sifting or screening device includes inner and outer concentric screened enclosures which rotate about a common axis. An inlet is provided at one axial end of the inner enclosure and an outlet is provided at the opposite axial end of the enclosures for the material that was too large to pass through the openings defined by the screens. An inclined dead plate or baffle member is provided at the inlet to prevent material fed in through a chute from impinging directly on the screen material and a pressurized air system presents a pulsating curtain of air to disengage material which has become lodged in the screen. A novel support system includes a circular support surface at the inlet end which rides on a pair of bearings and a central axle coincident with the axis of rotation driven by a motor at the outlet end. The axis of rotation is caused to lie at a small angle to the horizontal so that material which will not pass through the screens will slowly fall toward the outlet end of the enclosures.

12 Claims, 9 Drawing Figures

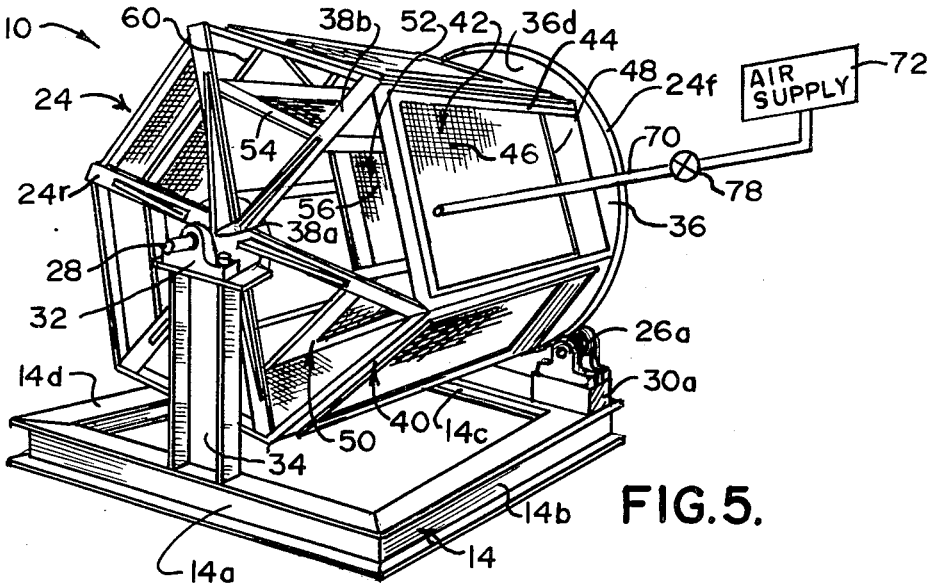
FIG.5.
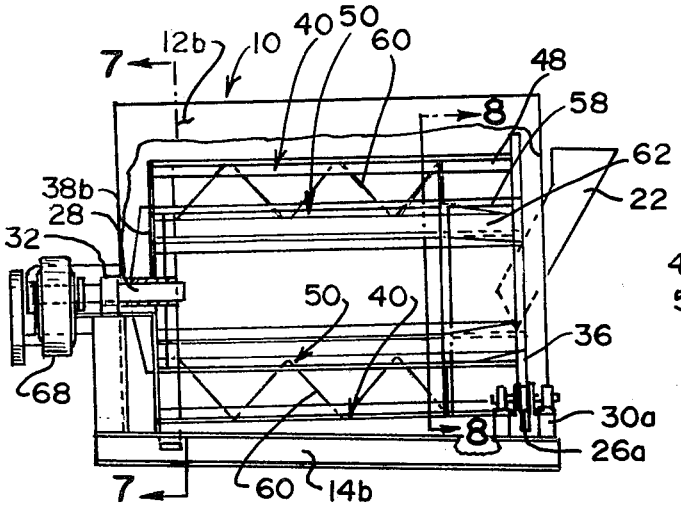
FIG.6.
FIG.7.
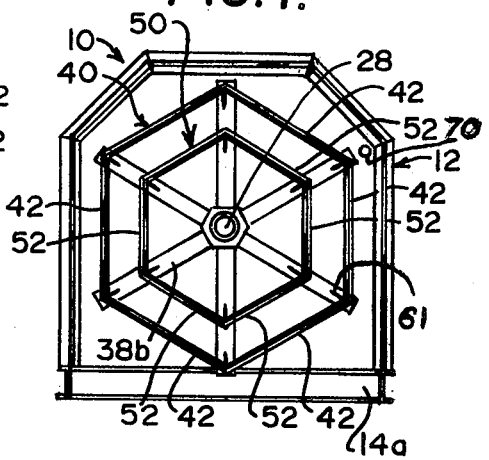
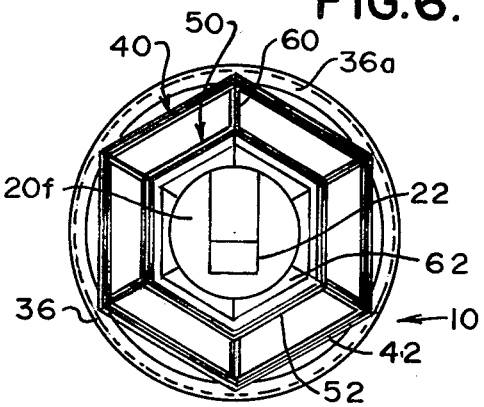
FIG.8.
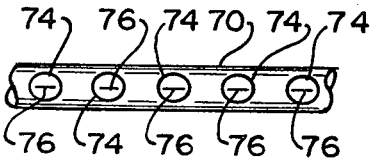
FIG.9.

ROTARY SIFTING DEVICE

BACKGROUND AND SUMMARY OF THE INVENTION

The invention relates to sifting devices which utilize a screen to separate particles which are small enough to pass through the openings defined by the screen from particles which are too large to do so.

In recent years it has become of greater importance to recycle usable materials in almost all industries. For example, in the foundry industry finely ground sand is used to fashion a mold into which is poured molten metal. After the metal has cooled and solidified the excess sand is shaken off and the rough casting is then cut, ground, polished and otherwise treated until it is ready for the customer. The sand is returned to a storage bin for reuse. Throughout this process particles of the sand or "dirt" are mixed with particles of metal scrap. It is important to reuse as much of the sand and metal as possible, but first the two components must be separated.

In an iron foundry the task of separating the metal from the sand is simply accomplished by the use of a magnet; however, when working with non-ferrous metals such as aluminum or bronze the magnet technique is of course useless. Since the fine sand particles are for the most part smaller than the particles of metal it is possible to separate the two by sifting the mixture through a fine horizontal screen which may be made to vibrate; however, it has been found that this process is unsatisfactory in that the sand is usually moist and sticks together causing it to plug up or fall off the sides of the screen instead of sifting through the screen.

Where such problems as hereinabove stated exist, it has been found that an efficient and effective sifting process can be performed by the invention described hereinbelow.

The invention includes concentrically rotating inner and outer screened enclosures. The openings defined by the screen of the inner enclosure are larger than the openings defined by the screen of the outer enclosure. Material to be sifted is introduced into the inner enclosure through a chute at one axial end thereof. A dead plate or baffle member protects the screen from being damaged by the force of the incoming material. The axis of rotation is directed downwardly from the inlet end toward horizontal at an angle of 1 to 5 degrees, and preferably 2 degrees, so that the material entering through the inlet will slowly travel by the force of gravity toward the axial opposite end of the enclosures. The material which does not sift through both screened enclosures will eventually fall out the opposite end of the enclosures and the fine material which sifts through both screens during the rotation process may be used again.

The sifting device according to the present invention also includes a number of other novel features. There is provided a circular support surface radially outward of the inlet opening. The support surface rests on a pair of trunnion supported bearings for rotation of the support surface thereon. This structure allows for a large inlet opening which helps to prevent plugging of the inlet by the wet sand. At the opposite or outlet end of the device there is provided a support axle coincident with the axis of rotation, which axle is driven by a conventional motor and transmission system. The provision of this rotational mounting system allows for a central feed at the inlet end free of obstruction or the possibility of damaging critical moving parts, and for an outlet at the opposite end of the enclosures which is likewise free from the possibility of damage from the material being processed.

Also, there is provided lifting blades extending radially inwardly and substantially normal to the screens and parallel to the axis of rotation within each enclosure. These blades act to lift the material being processed and throw the material against the screens to help break up lumps of material.

Further, in order to prevent material from lodging in the screen and thus preventing efficient operation of the machine, there is provided a pressurized air supply line positioned outside the enclosures. The supply line runs parallel to the axis of rotation and includes a plurality of nozzles directed radially inward toward the screens. As the screen passes by the nozzles, a blast of air is directed toward the screen to disengage particles lodged in the screen. The nozzles each have a convex head with a linear slot therein running in the same direction as the supply line. Thus the blast of air eminating from the nozzles will be in the form of a thin wall of air directed along the entire length of the screen.

It is therefore one of the objects of the invention to provide a rotary sifting device which will effectively and efficiently separate fine particles from coarser particles by sifting material through a rotating screened enclosure.

Another object of the invention is to provide a support system for a rotary sifting machine which permits an inlet at one axial end thereof and an outlet at the opposite axial end thereof without obstruction or possibility of damage to the supporting moving parts.

Still another object of the invention is to provide a rotary sifting machine which introduces the material to be sifted to a first screen of relatively large openings and then to a second screen of relatively small openings.

It is a further object of the invention to provide means for disengaging material which may be lodged in the sifting screen during the sifting process.

It is a still further object of the invention to provide a means for pouring material into a rotary sifting device without damaging the screen area of the device.

Other objects of this invention will be apparent to those skilled in the art in light of the following description and accompanying drawings.

BRIEF DESCRIPTION OF THE DRAWINGS

In the drawings,

FIG. 5 is a perspective view showing the side opposite to that shown in FIG. 4 with the entire cover, base and drive apparatus removed;

FIG. 6 is a side view partially in section showing the side opposite to that shown in FIG. 1;

FIG. 7 is a cross-sectional view taken along line 7—7 of FIG. 6;

FIG. 8 is a cross-sectional view taken along line 8—8 of FIG. 6; and FIG. 9 is a diagrammatic view of the air supply line nozzles.

DESCRIPTION OF THE PREFERRED EMBODIMENT

With reference to the drawings, there is shown a preferred form of a rotary sifting device 10 embodying the principles of the present invention.

Figure 1:
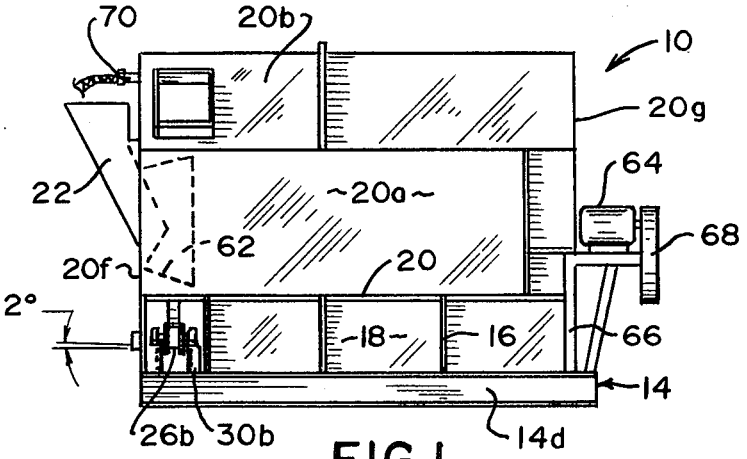
FIG. 1 is a side view of the rotary sifting device according to the principles of the invention.
Figure 2:
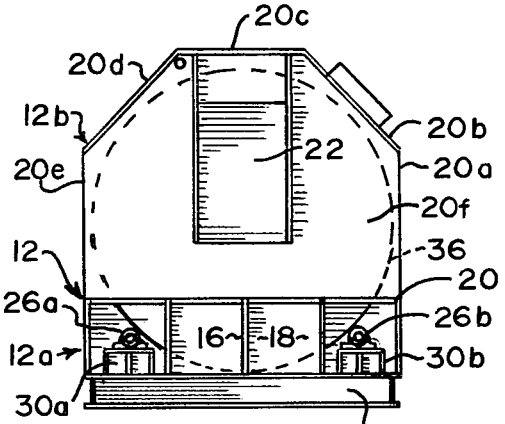
FIG. 2 is an end view of the device showing the inlet end of the invention.
Figure 3:
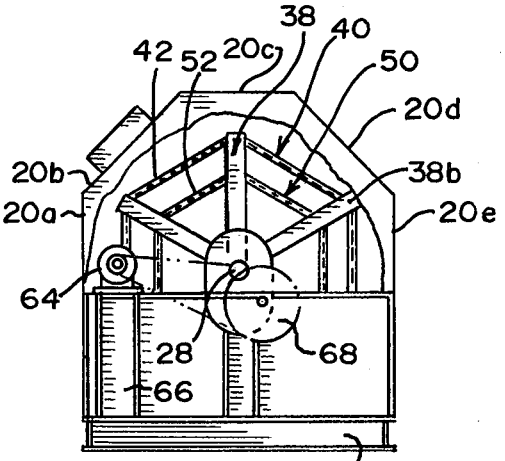
FIG. 3 is an end view showing the end opposite to that shown in FIG. 2 with the cover partially cut away.

Rotary sifting device 10 is provided with an exterior housing 12 mounted upon a suitable rectangular foundation structure 14 shown in FIG. 5 as comprising rear I-beam 14*a*, side beam 14*b*, front beam 14*c* and side beam 14*d*, all of which are adapted to rest upon a level, horizontal floor (not shown). Housing 12 includes a base section 12*a* including a plurality of upstanding beams represented by the numeral 16 which are joined around a major portion of base section 12*a* by sheet metal members represented by the numeral 18. Across the top of upstanding beams 16 and sheet metal members 18 is affixed a horizontal railing 20 which supports the cover section 12*b* of housing 12. Cover section 12*b* consists of a plurality of interconnected planar members 20*a*, 20*b*, 20*c*, 20*d* and 20*e*, which may be of solid sheet metal or fine mesh screening. Further, front end member 20*f* and rear end member 20*g* are included to interfit with the other members of upper portion 12*b* to produce an enclosure from which particles of sand or other like projectiles will be prevented from escaping. Cover section 12*b* of housing 12 is constructed such that it may be removed from lower portion 12*a* for ready access to the interior thereof. For example, one or more of planar members 20*a*, 20*b*, 20*c* and 20*e* may be hinged at contiguous edges thereof to permit swinging of the members outwardly and facile removal of upper portion 12*b*. As best seen in FIGS. 1 and 2, front end member 20*f* of cover section 12*b* is fabricated with a rectangular opening through which extends an inlet chute 22 which is secured to front end member 20*f*.

Within housing 12 there is mounted for rotation a sifting wheel generally indicated by the numeral 24. Wheel 24 is supported at the forward end thereof by a pair of grooved bearings 26*a* and 26*b* and at the rearward end thereof by a central axle 28. Bearings 26*a* and 26*b* are mounted on suitable support blocks 30*a* and 30*b*, respectively, which in turn are supported by foundation structure 14. Axle 28 is mounted for rotation within bearing member 32 which is carried on an upwardly extending beam 34 affixed upon horizontal beam 14*a*.

Figure 4:
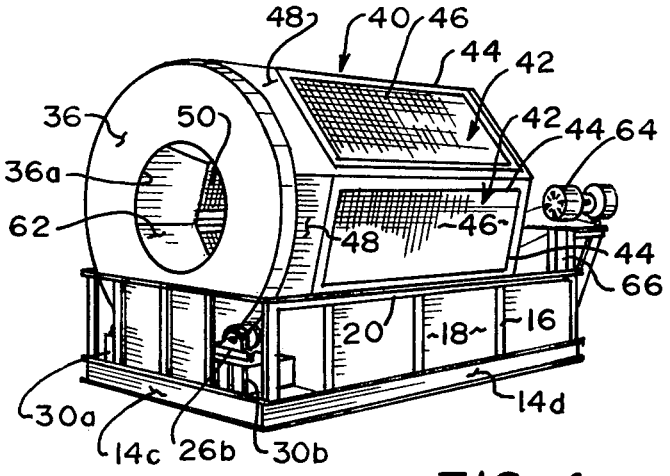
FIG. 4 is a perspective view of the invention with the cover removed.

Sifting wheel 24 includes at the forward end thereof, a large, circular disc 36 with a central feed hole 36*a* therethrough. The outer circumference of disc 36 acts as a support surface for wheel 24 and is supported for rotation on bearings 26*a* and 26*b*. Disc 36 rides securely within the grooves of bearings 26*a* and 26*b* as shown in FIGS. 1 and 4. At the rearward end of wheel 24 there is located a spider structure 38 keyed for rotation along with axle 28. In the preferred form, spider 38 includes a central hub 38*a* engaged around and keyed to axle 28 and six arms 38*b* extending radially outward from hub 38*a* and equally spaced therearound. An outer sifting screen enclosure 40 is supported between spider structure 38 and disc 36 and includes six identical planar sections 42. Each of planar sections 42 is comprised of a rectangular frame 44 having mounted therein a metal sifting screen 46. Screen 46 occupies the major extent of the planar area of section 42; however, a forward portion 48 of each of planar sections 42 is fabricated of solid material. The rearward corners of each of planar sections 42 of outer sifting enclosure 50 are attached to the extreme outer ends of two adjacent arms 38*b* while the forward corners thereof are attached to the inner surface 36*d* of disc 36 at locations which will not interfere with the rolling movement between disc 36 and bearings 26*a* and 26*b*. As shown in the drawings, the six planar sections 42 are mounted with the edges thereof contiguous with adjacent identical sections to form with disc 36 and spider structure 38, a six-sided enclosure which will rotate about the axis of rotation of axle 28. It is noted at this point that the axis of rotation of enclosure 40 is not horizontal but slopes at an angle from the forward end 24*f* of wheel 24 downwardly toward the rearward end 24*r* of wheel 24 at a slight angle of one to five degrees, preferably of about 2 degrees, to the horizontal prescribed by foundation structure 14.

Wheel 24 also includes an inner sifting enclosure 50 constructed similarly to that of outer sifting enclosure 40 in that enclosure 50 is formed of six identical planar sections 52, each comprised of a rectangular frame 54 having mounted therein a metal sifting screen 56. While screen 56 occupies the major extent of the planar area of section 52, the forward portion thereof 58 (See FIG. 6) which lies directly radially inwardly of portion 48 of a respective outer section 42 is fabricated of solid material. The rearward corners of each section 52 is attached to adjacent arms 38*b* of spider structure 38 and the forward edges of each section 52 is connected to disc 36 such that a section 52 lies radially inward and parallel to a respective one of the sections 42. The six planar sections 52 are mounted with the edges thereof contiguous with adjacent inner sections 52 to form with disc 36 and spider structure 38 the six sided enclosure 50, which is concentric with enclosure 40 and will rotate about the same axis of rotation as enclosure 40. It is noted that the wire screens 46 held in outer members 42 define openings which are smaller than those openings defined by wire screens 56 of inner planar sections 52. Preferably, the openings of wire screens 56 are about $\frac{1}{2}\times\frac{3}{4}$ inches while the openings defined by wire screens 46 are about $3/16\times\frac{3}{8}$ inches. Of course the size of the openings will depend upon the particular application for which the device is utilized. As best seen in FIGS. 6 and 8, in order to aid in maintaining the integrity of enclosures 40 and 50, there is provided a series of girder stabilizers 60 located between members 52 and members 42 along the plane created between the abutting edges of respective adjacent planar members. Stabilizers 60 are built as open truss work to allow sand to tumble between the inner screened enclosure 50 and outer screened enclosure 40.

Further, located at abutting edges of outer planar sections 42 and abutting edges of inner planar section 52 there is provided radially inwardly directed lifting blades 61 (see FIG. 7) which act to lift and throw material against the screens as sifting wheel 24 rotates.

Extending inwardly around feed hole 36*a* in disc 36 is a baffle member 62 which, as best seen in FIGS. 1 and 6, lies within the solid area defined by forward portions 58 of planar sections 52 and permits material to be fed onto screens 56. Owing to the slight angle between enclosure members 52 and baffle member 62, the radial force of material entering onto screens 56 will be much less than that which would be experienced by sections 52 if material were caused to enter directly from inlet chute 22 which employs a much greater angle of incidence with respect to sections 52. Also, while inlet chute 22 is necessarily stationary with respect to enclosure 50, baffle member 62 rotates with the enclosure 50 thus imparting rotational motion to the material being fed into device 10 prior to the introduction of the material onto screens 56.

Sifting wheel 24 is turned by a power source 64 such as an electric motor mounted on an upstanding beam 66. A conventional energy transmission system 68 acts to drive axle 28 at a relatively slow rotational velocity.

Positioned within housing 12 adjacent to the outer surface of outer enclosure 40 is an elongated air supply tube 70 connected to a conventional pressurized air supply 72. Tube 70 includes a plurality of nozzles 74, spaced along the extent of the tube which will overlie screens 46 of enclosure 40 as enclosure 40 turns beneath tube 70. While nozzles 74 are shown as being equally spaced along tube 70 it is contemplated to space the nozzles closer near the inlet end of the screens since there is more possibility of sand plugging the screens near the inlet end. Nozzles 74 are each convex and provided with elongated openings 76 facing radially toward enclosure 40. Elongated openings 76 are positioned such that the longitudinal extent thereof is parallel to the axis of tube 70 (see FIG. 9). Thus, when actuated, nozzles 74 cooperate to form a thin curtain of pressurized air eminating directly at and radially inwardly upon screens 46 along the entire longitudinal extent thereof. This action helps to disengage any material which may be lodged in the screens. Of course the actuation of pressurized air may be automatically controlled by a solenoid valve 78 positioned between the pressurized air supply 72 and nozzles 74. Solenoid valve 78 is intermittently actuated by a timer (not shown) to provide pulsating blasts of air.

In operation, material to be separated by sifting is fed into the upper opening of chute 22. The material falls through opening **36*a* in disc 36 into enclosure 50 and onto baffle member 62. As baffle member 62 is rotating with disc 36, the material is not only prevented from impinging directly onto screens 56 but is also imparted with rotary motion before entering onto screens 56 thus helping to preserve screens 56. Since the axis of rotation is sloped slightly toward end 24*r* of wheel 24, the material will slowly fall toward end 24*r* as it is also thrown up and into screens 56 by lifting blades 61. Material which is fine enough to pass through screens 56 will do so and enter into the annular space defined by enclosure 40 and enclosure 50. Material which is not fine enough to pass through the openings defined by screens 56 will eventually fall out of the outlet end 24*r* of enclosure 50. Material which is within the annular space defined by enclosures 40 and 50 will again be thrown up by lifting blades 61 as wheel 24 rotates and the material which is fine enough to pass through screens 46 will do so and will be conveyed away for reuse by conveyer means not shown. The particles which are not small enough to pass through screens 46 will eventually fall out of the rear end 24*r* of enclosure 40. The material which has exited through the rear axial end of enclosures 40 and 50 is also conveyed away by separate conveyer means, also not shown. Meanwhile, air supply tube 70 is intermittently or continuously actuated by valve 78** to provide a thin blast of air inwardly through the screens to disengage any material which has become lodged therein.

Numerous variations, within the scope of the appended claims, will be apparent to those skilled in the art in light of the foregoing description of the preferred embodiment and accompanying drawings. For example, enclosures 40 and 50 could be formed as regular cylinders rather than six sided enclosures; or wheel 24 could be driven by a power source connected to bearings **26*a* or 26*b* instead of axle 28**. These variations are merely illustrative.

Having thus described the invention, what is claimed and desired to be secured by Letters Patent is:

1. A rotary sifting device, comprising:

a disc mounted for rotation at a first end of said rotary sifting device;

a spider structure mounted for rotation at a second end of said rotary sifting device, said spider structure including a plurality of arms extending radially outwardly from a central hub;

a first screened enclosure mounted between said spider structure and said disc for rotation therewith, said first screened enclosure including a sizing screened portion;

a second screened enclosure mounted between said spider structure and said disc for rotation therewith and mounted concentrically inboard of said first screened enclosure, said second screened enclosure including a sizing screened portion and a baffle member portion, said baffle member portion defining an inlet for said rotary sifting device, said baffle preventing material entering said device at said second screened enclosure from impinging directly upon said second screened enclosure and for imparting rotational movement to said material prior to the introduction thereof onto the sizing screened portion of said second screened enclosure;

a pressurized air supply line having a plurality of nozzles directed radially inwardly toward said first screened enclosure, said nozzles including an outlet part axially aligned with each other outlet part of said nozzle plurality so as to direct a continuous axial air current radially inward of said first screened enclosure along the entire sizing screened portion of said first screened enclosure;

means for rotating at least one of said spider structure and said disc; and means for generating an air current through said nozzles to disengage material lodged in said first screened enclosure.

2. The device of claim 1 wherein each of said first and said second screened enclosures are six sided.

3. The device of claim 2 further including lifting blades extending axially of said device along the junction of pairs of said six sides forming said first and second screened enclosures and projection radially inwardly of said first and second screened enclosures for lifting material and throwing the material onto the respective ones of said screened enclosures during rotation thereof.

4. The device of claim 3 further including a plurality of stabilizer members positioned between said first and said second screened enclosures and joined thereto between abutting edges of adjacent ones of the sides forming said first and second screened enclosures.

5. The device of claim 1 further including timer means for regulating the time of air flow through said air line.

6. The device of claim 5 further including chamber means enclosing said first and said second screened enclosures.

7. The device of claim 6 further including access means in said cover means for permitting access into said device.

8. The device of claim 6 wherein said first and second screened enclosures are supported for rotation only at the central hub of said spider structure and said disc.

9. The device of claim 8 wherein said first and second screened enclosures are coaxial about an axis directed downwardly from a horizontal plane at an angle between one and five degrees.

10. A rotary sifting device, comprising:

a disc mounted for rotation at a first end of said rotary sifting device;

a spider structure mounted for rotation at a second end of said rotary sifting device, said spider structure including a plurality of arms extending radially outwardly from a central hub;

a first screened enclosure mounted between said spider structure and said disc for rotation therewith, said first screened enclosure including a sizing screened portion;

a second screened enclosure mounted between said spider structure and said disc for rotation therewith and mounted concentrically inboard of said first screened enclosure, said second screened enclosure including a sizing screened portion and a baffle member portion, said baffle member portion defining an inlet for said rotary sifting device, said baffle preventing material entering said disc at said second screened enclosure from impinging directly upon said second screened enclosure and for imparting rotational movement to said material prior to the introduction thereof onto the sizing screened portion of said second screened enclosure;

a plurality of stabilizer members positioned and extending between said first and said second screened enclosures and joined thereto so as to permit relatively free flow of material between said first and second screened enclosures;

a pressurized air supply having a plurality of nozzles directed radially inwardly toward said first screened enclosure, said nozzles including an outlet part axially aligned with each other outlet part of said nozzle plurality so as to direct a continuous axial air current radially inward of said first screened enclosure along the entire sizing screened portion of said first screened enclosure;

means for rotating one of said spider structure and said disc; and means for generating an air current through said nozzles to disengage material lodged in said first screened enclosure.

11. The device of claim 10 wherein the outlet part of said nozzle plurality each are convex and include an elongated opening position that the longitudinal extent thereof is parallel to the axis of said air supply line.

12. A rotary sifting device, comprising:

a disc mounted for rotation at a first end of said rotarylsifting device;

a spider structure mounted for rotation at a second end of said rotary sifting device, said spider structure including a plurality of arms extending radially outwardly from a central hub;

a first screened enclosure mounted between said spider structure and said disc for rotation therewith, said first screened enclosure including a sizing screened portion;

a second screened enclosure mounted between said spider structure and said disc for rotation therewith and mounted concentrically inboard of said first screened enclosure, said second screened enclosure including a sizing screened portion and a baffle member portion, said baffle member portion defining an inlet for said rotary sifting device, said baffle preventing material entering said device at said second screened enclosure from impinging directly upon said second screened enclosure and for imparting rotational movement to said material prior to the introduction thereof onto the sizing screened portion of said second screened enclosure;

a plurality of stabilizer members positioned between said first and said second screened enclosures and positioned to permit reltatively free material flow between said first and second screened enclosures;

a pressurized air supply line having a plurality of nozzles directed radially inwardly along said first screened enclosure, said nozzles including an outlet part axially aligned with each other outlet part of said nozzle plurality so as to direct a continuous axial air current radially inward of said screened enclosure along the entire sizing screened portion of said first and said second screened enclosures;

means for rotating one of said spider structure and said disc;

means for generating an air current through said nozzles to disengage material lodged in said first screened enclosure; and bearing means for supporting said disc and the central hub of said spider structure, said first and said second screened enclosures being supported for rotation only along the central hub of said spider structure and said disc, said first and said second screened enclosures being coaxial about an axis offset from a horizontal plane at an angle between one and five degrees.

* * * * *